US012768621B2

(12) United States Patent
Allgaier et al.

(10) Patent No.: US 12,768,621 B2
(45) Date of Patent: Oct. 20, 2026

(54) FIREARM TRAINING APPARATUSES, SYSTEMS AND METHODS OF USING

(71) Applicant: Mantis Tech, LLC, Oswego, IL (US)

(72) Inventors: Austin Allgaier, Oswego, IL (US); Ammon Allgaier, Oswego, IL (US)

(73) Assignee: Mantis Tech, LLC, Oswego, IL (US)

( * ) Notice: Subject to any disclaimer, the term of this patent is extended or adjusted under 35 U.S.C. 154(b) by 654 days.

(21) Appl. No.: 18/178,496

(22) Filed: Mar. 4, 2023

(65) Prior Publication Data

US 2023/0280134 A1 Sep. 7, 2023

Related U.S. Application Data

(63) Continuation of application No. PCT/US2021/049174, filed on Sep. 4, 2021.

(60) Provisional application No. 63/074,653, filed on Sep. 4, 2020.

(51) Int. Cl.
*F41G 3/26* (2006.01)
*F41A 3/12* (2006.01)

(52) U.S. Cl.
CPC ..... *F41G 3/2655* (2013.01); *F41A 3/12* (2013.01)

(58) Field of Classification Search
CPC ..... F41G 3/2655; F41G 3/323; F41G 3/26; F41A 3/12; F41A 9/61; F41A 19/06; F41A 33/00
See application file for complete search history.

(56) References Cited

U.S. PATENT DOCUMENTS

| | | | | |
|---|---|---|---|---|
| 5,119,576 | A * | 6/1992 | Erning | F41A 33/02 42/117 |
| 9,057,577 | B2 | 6/2015 | Hannan et al. | |
| 9,618,284 | B1 * | 4/2017 | Hoffman | F41A 7/08 |
| 9,719,748 | B2 | 8/2017 | Monti et al. | |
| 10,247,505 | B1 * | 4/2019 | Baxter | F41G 1/38 |
| 10,663,259 | B2 | 5/2020 | Allgaier | |
| 2011/0281242 | A1 * | 11/2011 | Charles | F41A 33/02 434/16 |
| 2013/0071815 | A1 | 3/2013 | Hudson et al. | |
| 2013/0203019 | A1 | 8/2013 | Nolen | |
| 2014/0065577 | A1 | 3/2014 | Quinlan et al. | |

(Continued)

FOREIGN PATENT DOCUMENTS

| | | |
|---|---|---|
| WO | 2014145079 A1 | 9/2014 |
| WO | 2016115554 A1 | 7/2016 |

OTHER PUBLICATIONS

International Search Report and Written Opinion issued on Apr. 12, 2016, in connection with International Application No. PCT/US2016/013760.

(Continued)

*Primary Examiner* — Dmitry Suhol
*Assistant Examiner* — Julie Grace Dosher
(74) *Attorney, Agent, or Firm* — Cook Alex Ltd.

(57) ABSTRACT

A firearm training system for retrofitting an existing rifle to allow for repeated dry firing of the rifle without having to manually reset the trigger after each shot. In some embodiments the system includes a bolt carrier group trigger resetter and a magazine battery pack. In some embodiments, the magazine battery pack is rechargeable. In some embodiments, the bolt carrier group trigger resetter includes a motor. In some embodiments, the bolt carrier group trigger resetter includes a laser.

20 Claims, 10 Drawing Sheets

(56) References Cited

U.S. PATENT DOCUMENTS

| | | | | |
|---|---|---|---|---|
| 2014/0154647 | A1 | 6/2014 | Nolen | |
| 2014/0272807 | A1 | 9/2014 | Guenther et al. | |
| 2015/0226509 | A1* | 8/2015 | Hadler | F41A 33/06 434/18 |
| 2015/0253109 | A1 | 9/2015 | Wichner | |
| 2015/0300766 | A1* | 10/2015 | Sims | A63F 9/02 434/16 |
| 2016/0252326 | A1 | 9/2016 | Jones et al. | |
| 2016/0313097 | A1 | 10/2016 | Miller et al. | |
| 2017/0363390 | A1 | 12/2017 | Allgaier | |
| 2018/0259307 | A1* | 9/2018 | Billings | F42B 8/08 |
| 2020/0263956 | A1 | 8/2020 | Allgaier | |
| 2021/0247160 | A1 | 8/2021 | Packes | |
| 2021/0262752 | A1* | 8/2021 | Seigler | F41A 19/06 |

OTHER PUBLICATIONS

International Preliminary Report on Patentability issued on Jul. 18, 2017, in connection with International Application No. PCT/US2016/013760.

"(First Look) Mantis BlackBeard—AR-15 Auto-Resetting Trigger System" USA Carry, Jan. 21, 2020; https://www.youtube.com/watch?v=g-xVAnuP3Kk>.

International Search Report and Written Opinion issued on Dec. 14, 2021, in connection with International Application No. PCT/US2021/49174.

International Preliminary Report on Patentability issued on Mar. 7, 2023, in connection with International Application No. PCT/US2021/49174.

* cited by examiner

FIREARM TRAINING APPARATUSES, SYSTEMS AND METHODS OF USING

CROSS-REFERENCE TO RELATED APPLICATIONS

This application is a continuation of and claims priority benefits from International Application No. PCT/US2021/049174 filed on Sep. 4, 2021, entitled "Firearm Training Apparatuses and Methods of Using". The '174 application, and the present application, claim priority benefits from U.S. provisional application No. 63/074,653 filed on Sep. 4, 2020, also entitled "Firearm Training Apparatuses and Methods of Using". The '653 and '174 applications are hereby incorporated by reference herein in their entireties.

FIELD OF THE INVENTION

The present invention relates to firearm training apparatuses, systems, and methods. In particular, the invention relates to apparatuses, systems, and methods for retrofitting an existing rifle to allow for repeated dry firing of the rifle without having to retract the charging handle, bolt, hammer, and/or other trigger resetting system(s) and/or device(s) of the rifle. The invention also relates to apparatuses, systems, and methods for repeated dry firing of the rifle without having to manually manipulate the mechanism of the rifle in order to reset the trigger for repeated shots.

SUMMARY OF THE INVENTION

In some embodiments, a firearm training system can include a bolt carrier group trigger resetter; a magazine battery pack; a laser, and/or a rifle. In some embodiments, the bolt carrier group trigger resetter is configured to replace a bolt carrier group of a rifle and/or a charging handle of a rifle.

In some embodiments, a magazine battery pack is not utilized. In some such embodiments, the bolt carrier group trigger resetter can include a battery.

In some embodiments, a magazine battery pack also functions to reset the trigger without the need of a separate bolt carrier group trigger resetter.

In some embodiments, the rifle is a semi-automatic rifle. In some embodiments, the rifle is an automatic rifle. In some embodiments, the rifle is an AR-15 pattern rifle. In some embodiments, the rifle is one of an AK pattern rifle, M1A, M4, M16, MPS, SKS, or a 10-22.

In some embodiments, the magazine battery pack includes a contact to connect the magazine battery pack to and power the bolt carrier group trigger resetter.

In some embodiments, the bolt carrier group trigger resetter is weighted to simulate the weight of a traditional bolt carrier group. In some embodiments, the magazine battery pack is weighted to simulate the weight of a traditional loaded magazine.

In some embodiments, the magazine battery pack includes a lithium-ion battery. In some embodiments, the magazine battery pack includes at least one rechargeable battery.

In some embodiments, the magazine battery pack is configured to work with conventional replaceable batteries.

In some embodiments, the bolt carrier group trigger resetter includes an electric motor. In some embodiments, the electric motor is a solenoid. In some embodiments, the electric motor is a servomotor. In some embodiments, the electric motor is a DC rotary motor. In some embodiments, the electric motor is an AC rotary motor.

DETAILED DESCRIPTION OF ILLUSTRATIVE EMBODIMENT(S)

Figure 1:
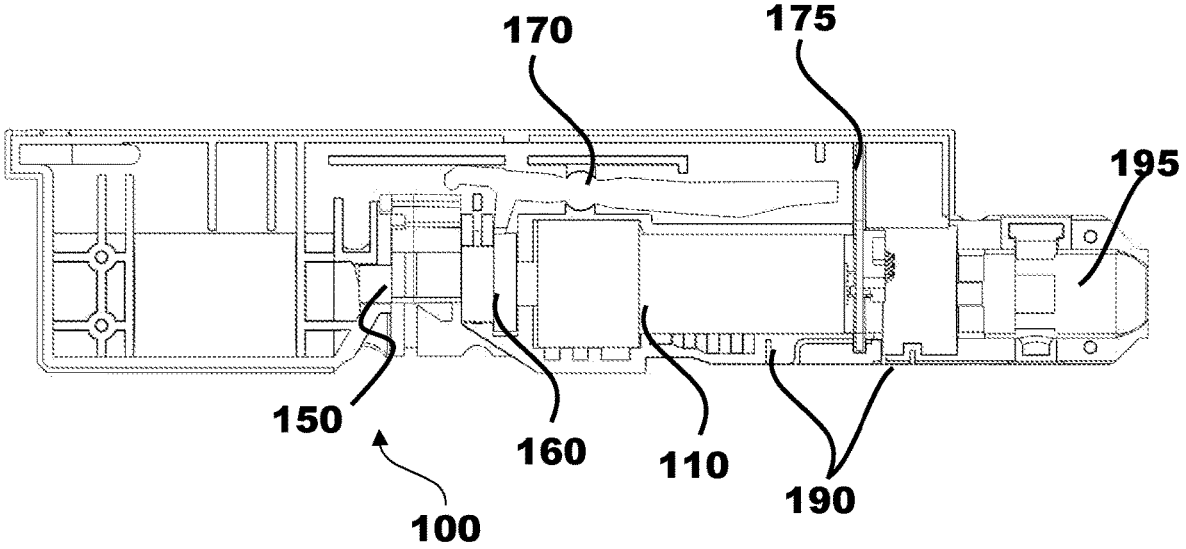
FIG. 1 is a cutaway side view of a bolt carrier group trigger resetter.
Figure 2:
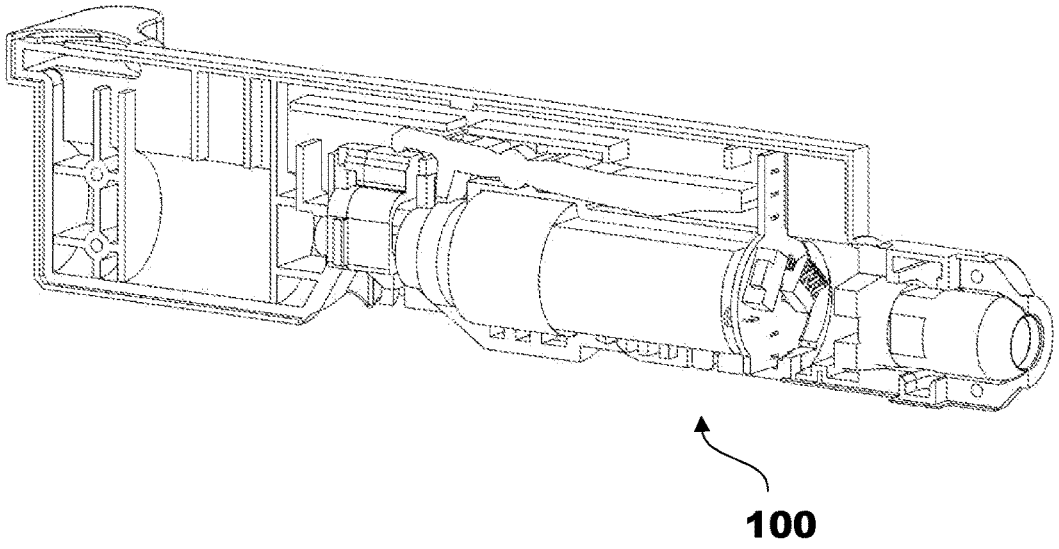
FIG. 2 is a cutaway perspective front view of a bolt carrier group trigger resetter.
Figure 3:
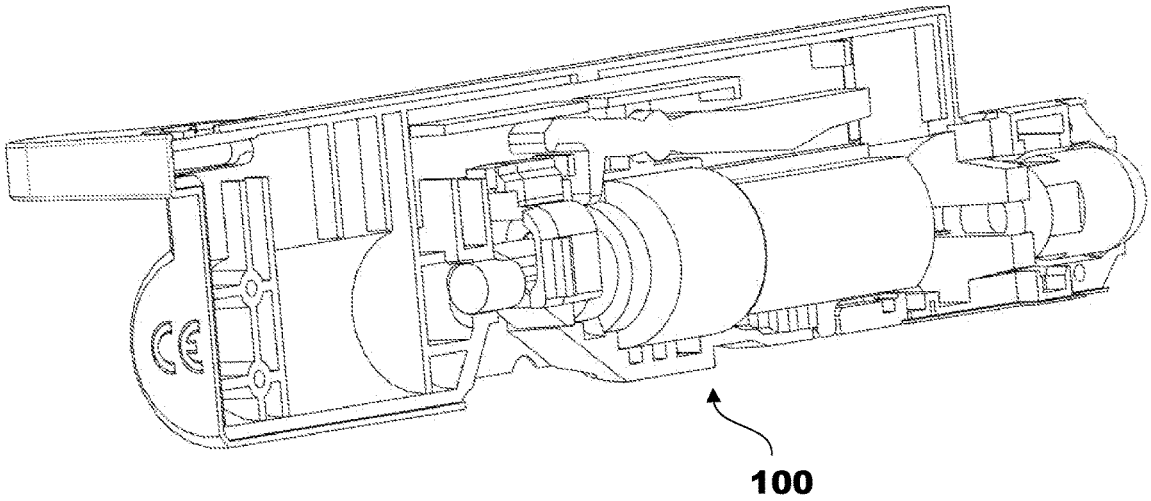
FIG. 3 is a cutaway perspective back view of a bolt carrier group trigger resetter.
Figure 4:
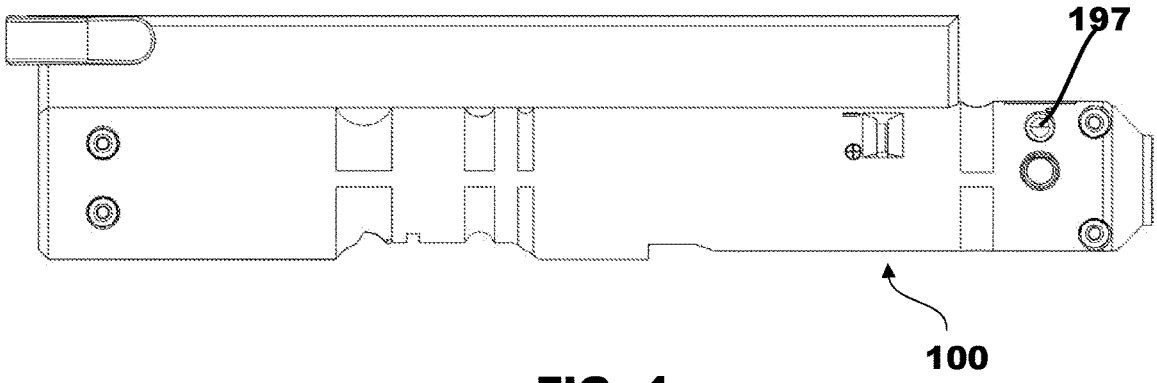
FIG. 4 is a side view of a bolt carrier group trigger resetter.
Figure 5:
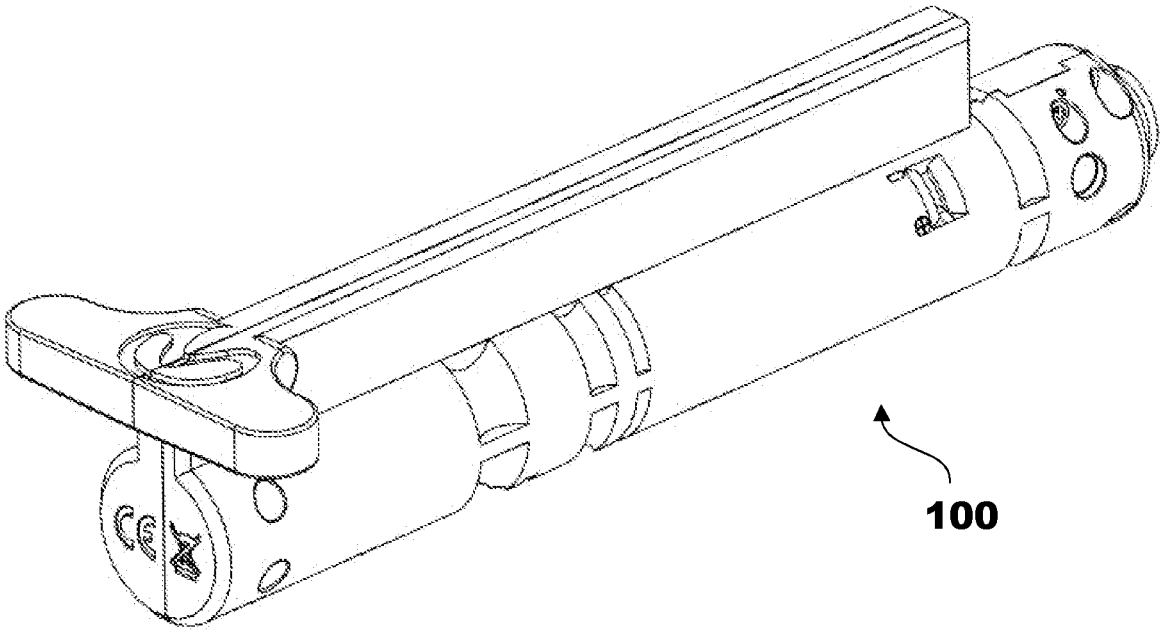
FIG. 5 is a perspective back view of a bolt carrier group trigger resetter.

When dry firing a fully functioning rifle traditionally the rifle's trigger mechanism remains in the fired position without resetting after each time the trigger is pulled. Thus, a shooter practicing dry firing must pull back the charging handle, bolt, hammer, or other trigger resetting system and/or device of the rifle after each shot due to there not actually being a round fired to reset the mechanism. This is unnatural training for many types of semi-automatic firearms. A firearm training apparatus and/or system can be used with a traditional rifle to automatically reset the trigger mechanism when dry firing.

In some embodiments, the firearm training system allows for a finite number of shots before requiring the user to "reload" the magazine. In this way the system better simulates real life firing. In some embodiments, the system simulates firing failures, such as gun jams, to better simulate real life firing.

In some embodiments, the firearm training system can simulate firing malfunctions. In some embodiments, when a malfunction is simulated, the system can stop functioning until the user performs the prescribed actions that would be done in a live fire situation should such a malfunction occur. For example, in some embodiments the system could simulate a failure to feed/fire, and the user would need to slap the magazine, pull the charging handle to the rear, observe the chamber area, release the charging handle, and/or tap the forward assist plunger before the system would reengage with its trigger resetting capability. In some embodiments, the simulated malfunctions are scheduled to perform after a random number of shots., for example once every 10 to twenty shots. In some embodiments, the frequency of these simulated malfunctions can be adjusted to either occur more frequently, less frequently, consistently, or not at all. In some embodiments, the firearm training system can be configured to only present one type of malfunction. In some embodiments, the firearm training system can be configured to only present multiple types of malfunctions. In some embodiments, a user can choose which type(s) of simulated malfunction(s) will present themselves during a particular session. In some embodiments, this allows a user to practice on particular firearm skills.

In some embodiments, a sensor unit is included in the system. In some embodiments, the firearm training system can measure and record motion of the firearm. In some embodiments, the sensor unit can comprise motion-tracking devices including, but not limited to, one or more from the following list: a laser, a magnetometer, a global positioning system (GPS), an inertial measurement unit (IMU), accelerometers and a gyroscope.

In some embodiments the system transfers data collected and recorded by the firearm training system to an external data collection and analysis system. External data collection and analysis system can be located at a distance from the firearm. Transmission of data from the firearm to the external data collection and analysis system can be via a wired connection or a wireless communications link. In some embodiments, the system can transmit signals via one of several wireless communications protocols, such as Bluetooth, Wi-Fi, CDMA, 900 MHz, 3G/4G/5G/Cellular, near-field communication, and/or other communication protocols to a network. In some embodiments, the external data collection and analysis system can be located on a mobile device such as a mobile phone or smartphone, a tablet computer, a notebook computer, a laptop computer, a desktop computer or other suitable electronic computing device.

FIG. 1-5 illustrate bolt carrier group trigger resetter 100. In at least some embodiments, bolt carrier group trigger resetter 100 replaces certain parts of a rifle (not shown) including but not limited to the bolt, bolt carrier group, barrel, springs, and/or charging handle. In at least some embodiments, bolt carrier group trigger resetter 100 is configured to allow for repeat dry firing of a rifle without having to retract the charging handle, bolt, hammer, or other trigger resetting system or device of a rifle. In some embodiments, this allows an individual to practice firing the rifle as though it were live firing without any nonstandard manipulations of the firearm.

In some embodiments, the system can include two parts in the upper of the firearm: a bolt carrier group replacement and a charging handle replacement. In at least some of these embodiments, the charging handle can be pulled backward to simulate racking the charging handle.

In some embodiments, bolt carrier group trigger resetter resets the rifle when the hammer falls and the gun is fired. This firing process occurs due to the pressure applied to the trigger by the user. In at least some embodiments, the rifle is reset by engaging the bolt, hammer, trigger assembly, and/or other internal or external parts of the gun in order to reset the firing mechanism of the gun.

In at least some embodiments, bolt carrier group trigger resetter 100 renders the rifle inert.

In at least some embodiments, the rifle is left completely operational, save for the fact that no ammunition is being fired. In some embodiments, the safety of the rifle still functions when using bolt carrier group trigger resetter 100.

In at least some embodiments, bolt carrier group trigger resetter 100 resets the trigger mechanism of a rifle allowing the user to manipulate the trigger reset uninhibited and fire a follow up shot if desired.

In some embodiments, bolt carrier group trigger resetter 100 includes motor 110 to engage crankshaft 162 to reset rifle hammer 130. In some embodiments, motor 110 is an electric motor. In some embodiments, motor 110 is a servomotor. In some embodiments, motor 110 is a solenoid. In some embodiments, lever 170 engages the bolt or trigger mechanism to cause the trigger to reset. In some embodiments, lever 170 is a mechanism that indicates the state of the resetter to facilitate the turning on and off of the motor at the proper time. In some embodiments, piston 150 is utilized in resetting the trigger.

Figure 12:
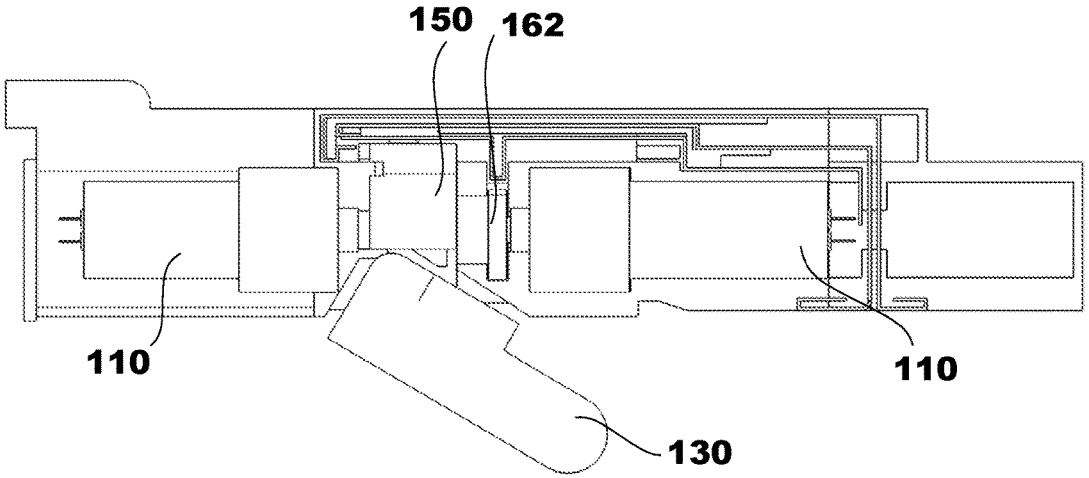
FIG. 12 is a cutaway view of an embodiment of an internal resetting mechanism where two motors turn a crankshaft driving a piston to reset the trigger.

In some embodiments, such as the one depicted in FIG. 12, multiple motors 110 are used.

In some embodiments, bolt carrier group trigger resetter 100 includes a microcontroller.

In at least some embodiments, bolt carrier group trigger resetter 100 includes a laser such as laser module 195 shown in FIG. 1. In some embodiments, the laser is configured to activate via an on-off switch. In some embodiments, the laser is configured to only activate after the trigger is pulled so a user can practice aiming without the laser guidance and then see the estimated or approximate point of impact. In some embodiments, the laser is in a consistent on-state to allow for zeroing. In some embodiments, the laser is "smart". In some embodiments, the laser is part of a system that calculates where a bullet would hit based on the distance to the target and/or environmental factors such as current wind. In some embodiments, the laser is configured to readjust itself so it appears at this calculated spot. In some embodiments, the laser can be adjusted using dial/switch 197. In some embodiments, laser module 195 can work with a laser recognition system.

In some embodiments, bolt carrier group trigger resetter 100 includes printed circuit board 175. In some embodiments a triggering sensor is connected to printed circuit board 175. In some embodiments the triggering sensor monitors the position of lever 170. In some embodiments, the triggering sensor is an optical sensor. In some embodiments, the triggering sensor is a hall effect sensor. In some embodiments, the triggering sensor is a microswitch.

FIG. 6-FIG. 12 illustrate various embodiments of internal resetting mechanisms.

Figure 6:
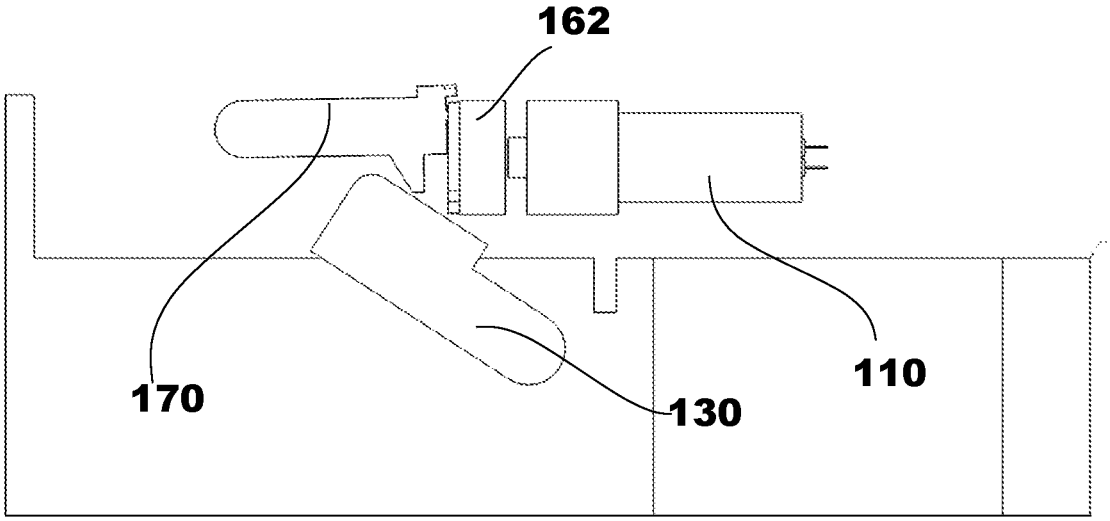
FIG. 6 is a cutaway view of an embodiment of an internal resetting mechanism with a motor attached to a lever through an intermediary part that transfers power from motor to the lever.

In the embodiment shown in FIG. 6, motor 110 is attached to lever 170 through crankshaft 162 that transfers power from motor 110 to the lever 170 to reset rifle hammer 130.

Figure 7:
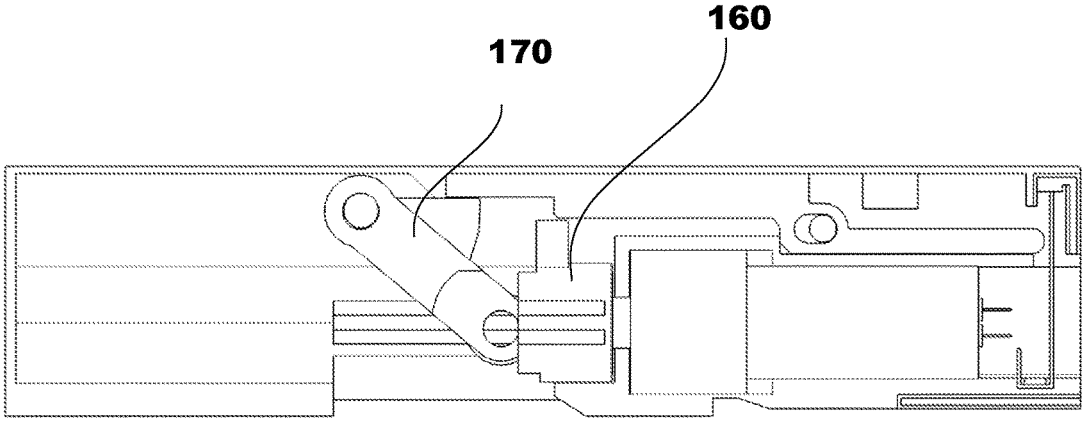
FIG. 7 is a cutaway view of an embodiment of an internal resetting mechanism with a motor driven lever.

FIG. 7 illustrates another embodiment of an internal resetting mechanism with a motor driven lever.

Figure 8:
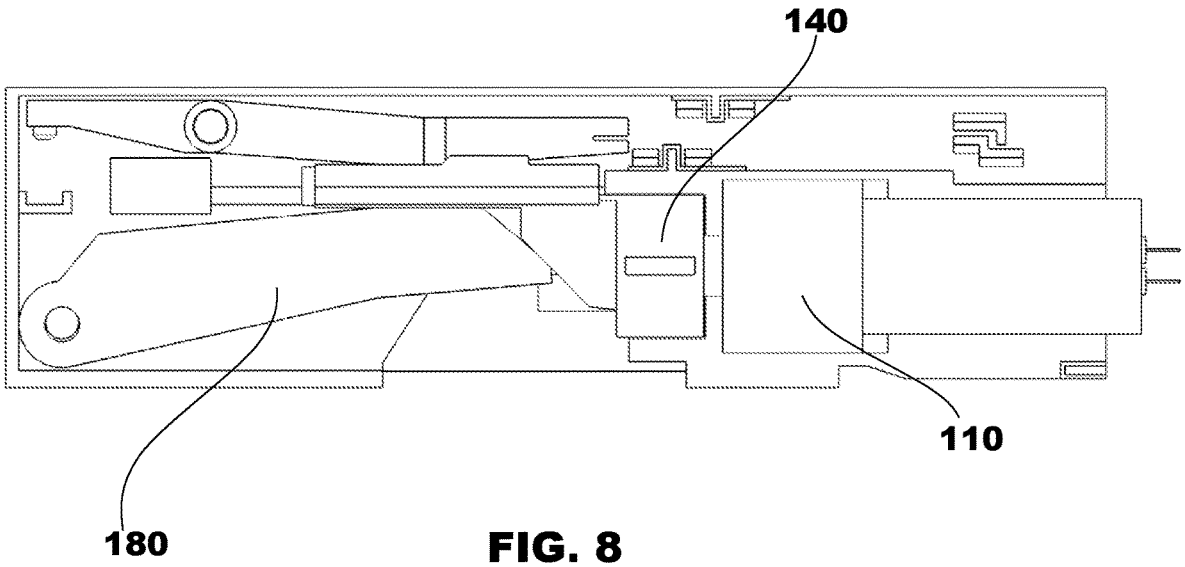
FIG. 8 is a cutaway view of an embodiment of an internal resetting mechanism wherein a motor dives a linear gear that activates a piston.

In the embodiment shown in FIG. 8, motor 110 drives linear gear 140 that activates piston 180.

Figure 9:
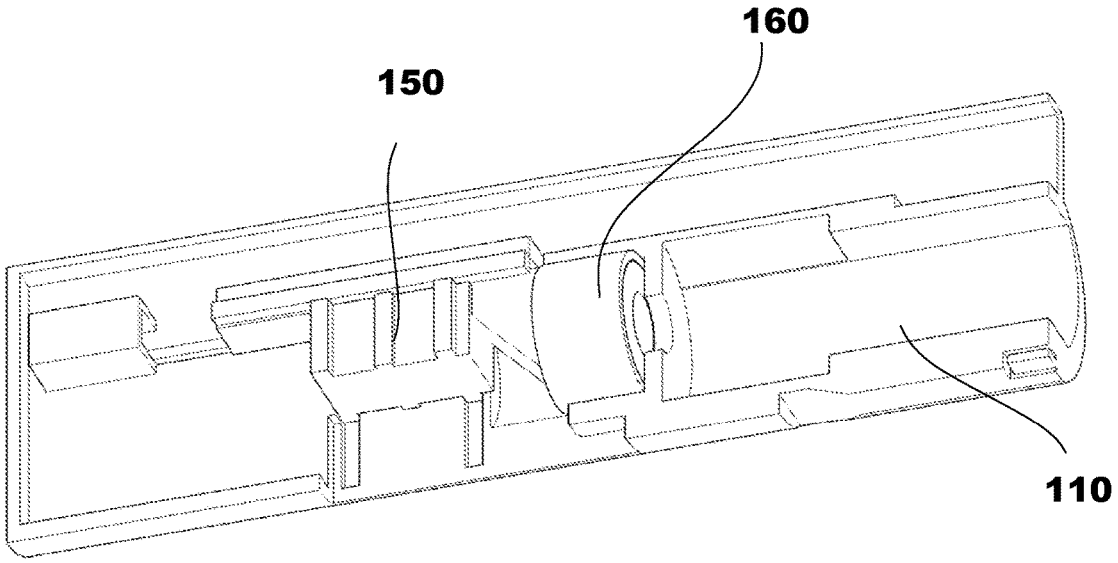
FIG. 9 is a cutaway perspective view of an embodiment of an internal resetting mechanism wherein a motor drives a gear which drives a piston which drives another piston.

In the embodiment shown in FIG. 9, motor 110 drives gear 160 which drives piston 150 which drives another piston.

Figure 10:
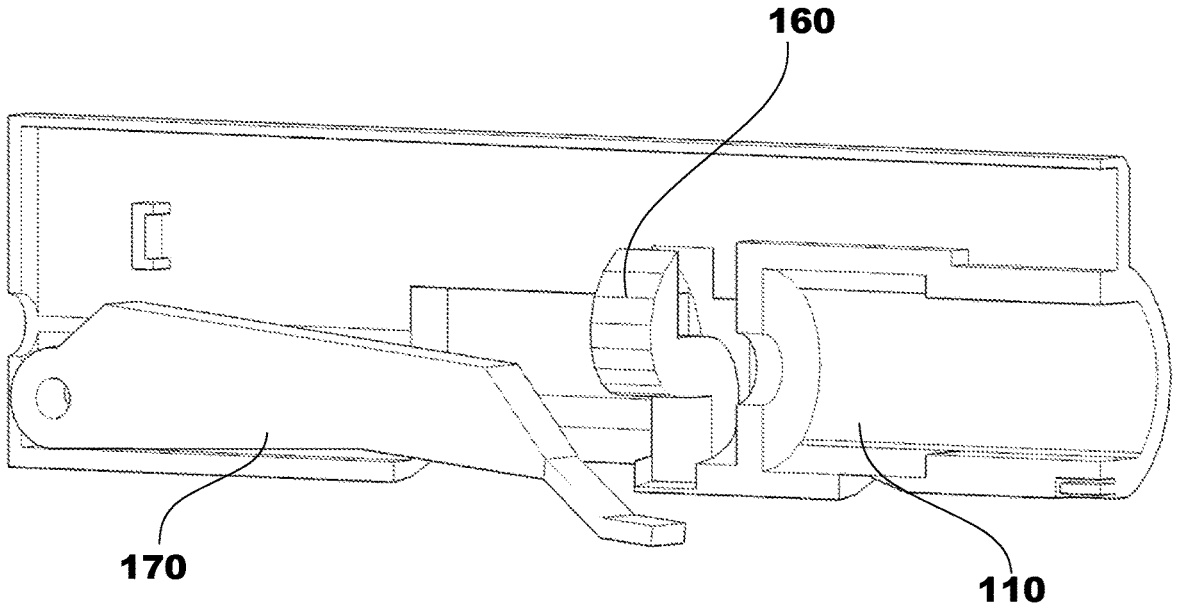
FIG. 10 is a cutaway perspective view of an embodiment of an internal resetting mechanism wherein the motor uses a half-turn to activate a lever.

In the embodiment shown in FIG. 10, motor 110 uses a half-turn of gear 160 to activate lever 170. In at least some embodiments, this half-turn gear allows the trigger to be reset twice as fast when compared to a gear requiring a full turn.

Figure 11:
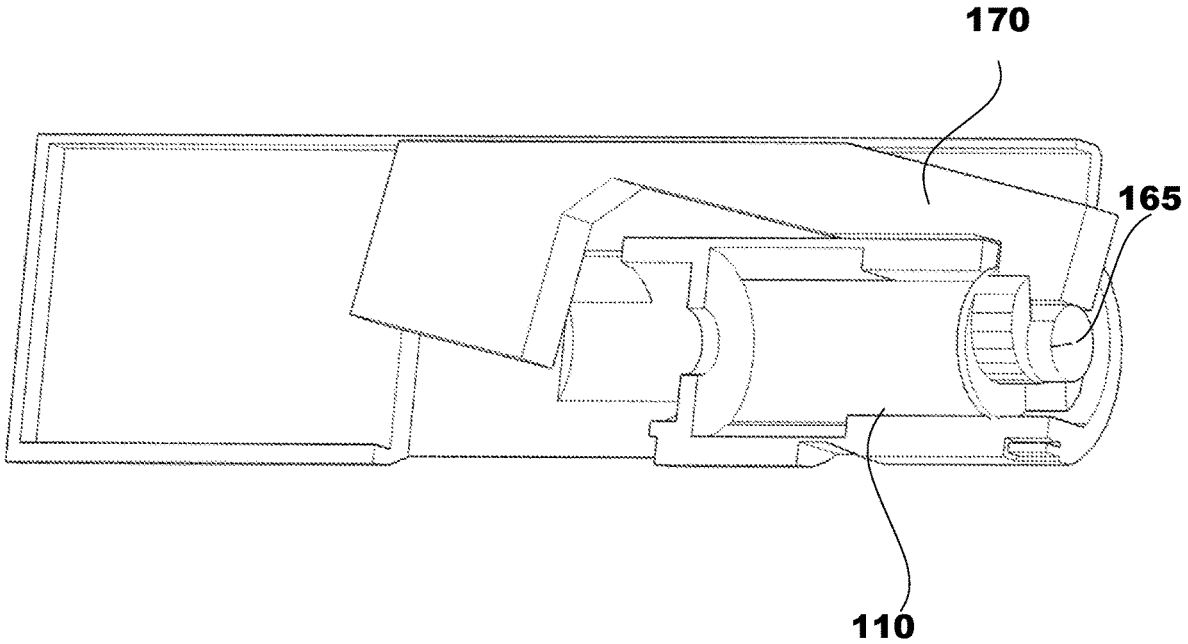
FIG. 11 is a cutaway perspective view of an embodiment of an internal resetting mechanism with a tapered gear attached to drive a lever.

In the embodiment shown in FIG. 11, tapered gear 165 is attached to drive lever 170. In at least some embodiments, this configuration allows for motor 110 to be placed in another position.

In the embodiment shown in FIG. 12, two motors 110 turn a crankshaft 162 driving piston 150 to reset rifle hammer 130. The use of multiple motors allows for faster and/or higher torque applications.

Figure 13:
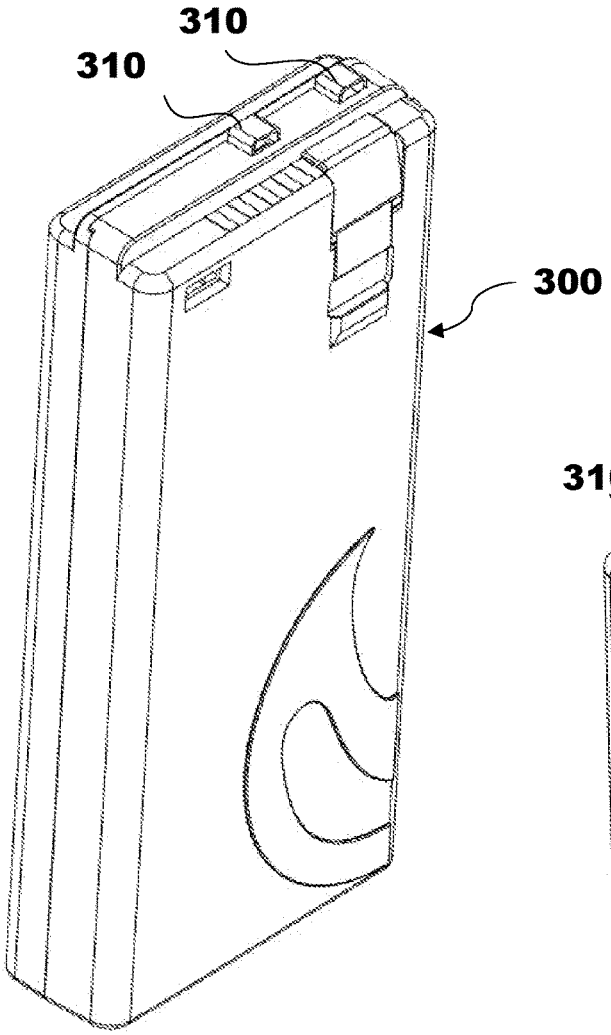
FIG. 13 is a perspective view of the front of a magazine battery pack.
Figure 14:
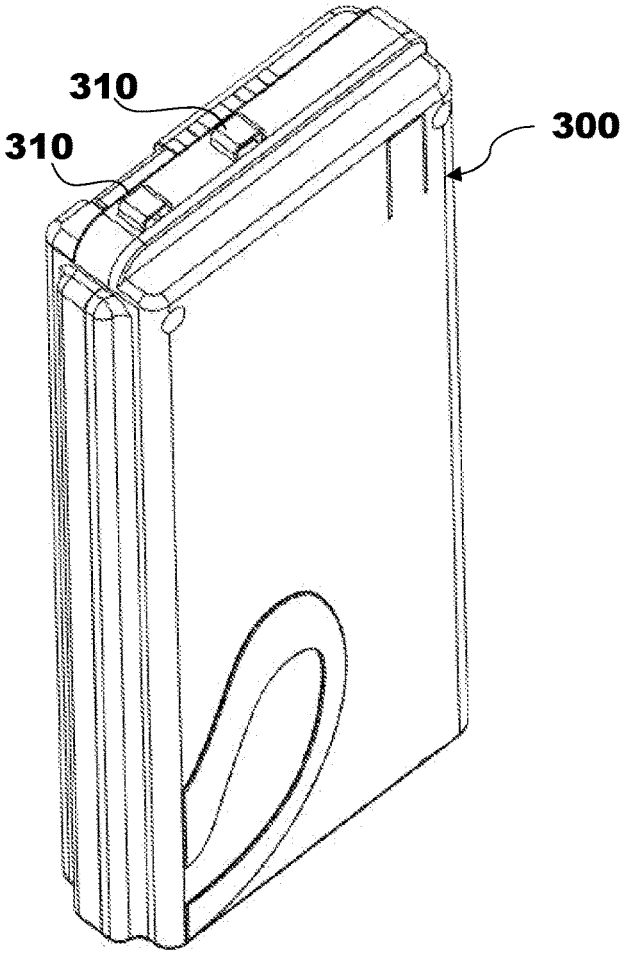
FIG. 14 is a perspective view of the back of a magazine battery pack.

FIG. 13 and FIG. 14 illustrate magazine battery pack 300. In at least some embodiments, magazine battery pack 300 includes contacts 310 to connect magazine battery pack 300 to the bolt carrier group trigger resetter 100 at bolt carrier group trigger resetter contacts 190. In some embodiments, magazine battery pack 300 is designed to replace the magazine of the rifle. In some of these embodiments, magazine battery pack 300 is weighted to simulate the weight of a traditional loaded magazine.

Figure 15:
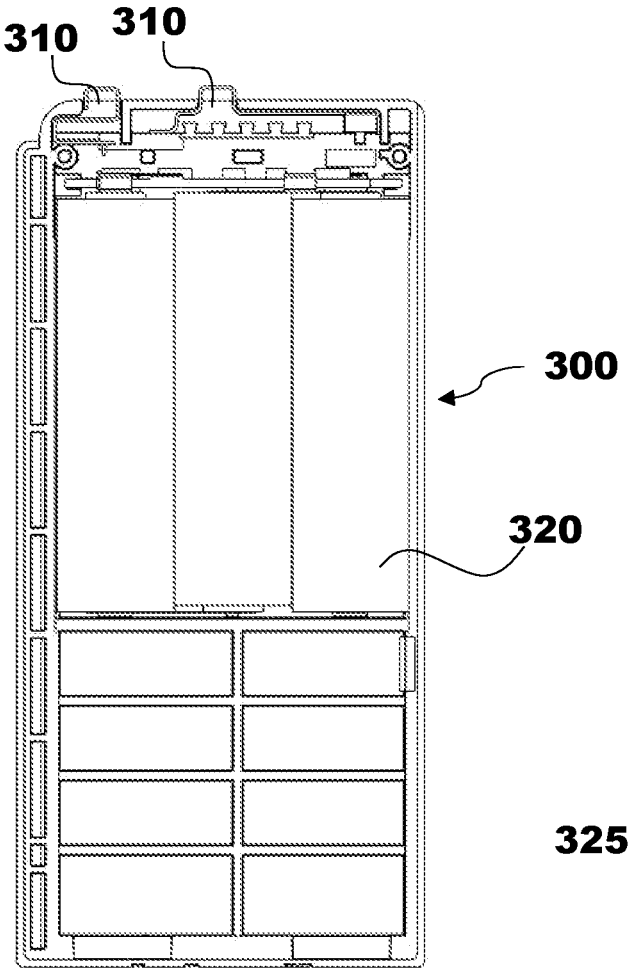
FIG. 15 is a cutaway back view of an embodiment of a magazine battery pack.
Figure 16:
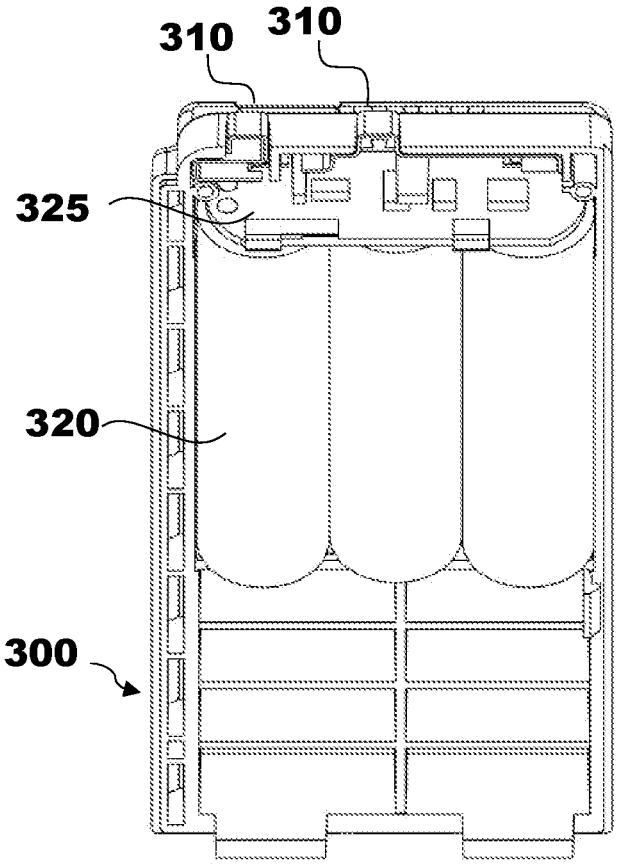
FIG. 16 is a cutaway perspective view of the back view of an embodiment of a magazine battery pack.

FIG. 15 and FIG. 16 illustrate cutaway views of magazine battery pack 300 including battery 320. In some embodiments, such as the one shown in FIG. 15 and FIG. 16, battery 320 is a lithium-ion battery. In some embodiments, battery 320 includes protection circuit module 325.

Figure 17:
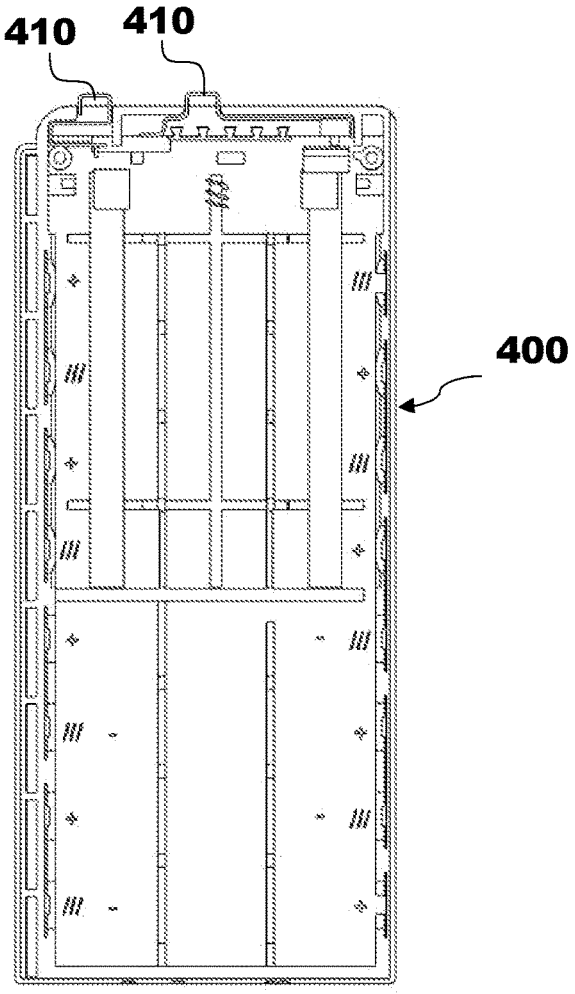
FIG. 17 is a cutaway back view of another embodiment of a magazine battery pack.
Figure 18:
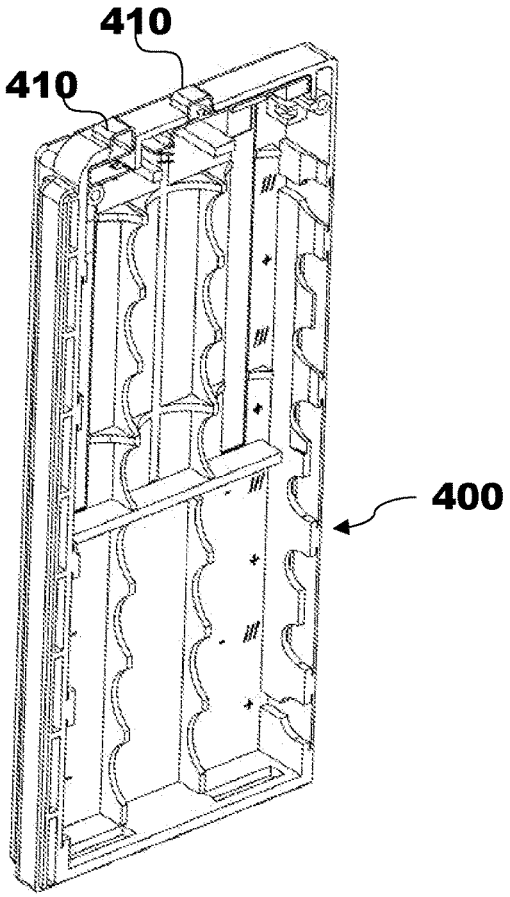
FIG. 18 is a cutaway perspective view of the back of another embodiment of a magazine battery pack.

FIG. 17 and FIG. 18 illustrate cutaway views of battery pack 400. In some embodiments, battery pack 400 includes contacts 410. In some embodiments, battery pack 400 is designed to work with conventional replaceable batteries such as nickel-based cylindrical cells. In some embodiments, these battery cells can be recharged. In some embodiments, this recharging can take place via contacts 410 and/or or via a cable attachment such as a USB cable or via additional contacts designed for recharging. In some embodiments, magazine battery pack 400 can be recharged wirelessly via inductive charging.

In some embodiments, the battery pack allows for at least 75,000 trigger resets before needing to be recharged.

While the illustrated embodiments show firearm training system using a bolt carrier group trigger resetter to reset the trigger and a magazine battery pack to supply power to the bolt carrier group trigger resetter, in some embodiments, the bolt carrier group trigger resetter has its own source of power. In some embodiments, the source of power comes from an externally mounted battery. In some embodiments, the trigger can be reset via a device that slides into the magazine well, such as a modified magazine battery pack. In some embodiments, the trigger can be reset via a device that attaches to the outside of the rifle. In some embodiments a battery is located within the bolt carrier group trigger resetter.

The apparatuses, systems, and methods described above can be applied in a wide variety of products and application areas including, but not limited to the following:

firearms and related accessories;

firearms instruction and training;

military training and exercises; and law enforcement and security personnel.

Throughout the above description the terms apparatus and system are and can be used interchangeably except when logic requires.

While particular elements, embodiments and applications of the present invention have been shown and described, it will be understood, that the invention is not limited thereto since modifications can be made by those skilled in the art without departing from the scope of the present disclosure, particularly in light of the foregoing teachings.

What is claimed is:

1. A firearm training system comprising:

a rifle;

a bolt carrier group trigger resetter configured to reset said rifle when a hammer of said rifle falls and the rifle is fired; and a battery, wherein said bolt carrier group trigger resetter comprises an electric motor and a crankshaft, wherein the electric motor is configured to engage the crankshaft, wherein said bolt carrier group trigger resetter is configured to replace a bolt carrier group of said rifle and a charging handle of said rifle.

2. The firearm training system of claim 1 further comprising a laser module.

3. The firearm training system of claim 2 wherein said laser module is configured to only activate after a trigger is pulled.

4. The firearm training system of claim 1 wherein said battery is a magazine battery pack that includes a contact to connect said magazine battery pack to said bolt carrier group trigger resetter.

5. The firearm training system of claim 4 wherein said magazine battery pack is weighted to simulate a weight of a loaded magazine used with said rifle.

6. The firearm training system of claim 4 wherein said magazine battery pack includes a lithium-ion battery.

7. The firearm training system of claim 4 wherein said magazine battery pack is configured to work with conventional replaceable batteries.

8. The firearm training system of claim 1 wherein said electric motor is a solenoid.

9. The firearm training system of claim 1 wherein said electric motor is a servomotor.

10. The firearm training system of claim 1 wherein said firearm training system is configured to reset a trigger of said rifle during dry firing.

11. The firearm training system of claim 1 wherein said rifle is a semi-automatic rifle.

12. The firearm training system of claim 1 wherein said rifle is an automatic rifle.

13. The firearm training system of claim 4 wherein said firearm training system allows for a finite number of shots before requiring a user to reload said magazine battery pack.

14. The firearm training system of claim 1 wherein said firearm training system simulates a firing failure.

15. The firearm training system of claim 14 wherein said firing failure is a gun jam.

16. The firearm training system of claim 1 wherein said firearm training system simulates a firing malfunction, wherein said firearm training system prevents said rifle from firing until a user performs an action.

17. The firearm training system of claim 16 wherein said firearm training system is configured so said firing malfunction activates after a random number of shots.

18. The firearm training system of claim 16 wherein a frequency of said firing malfunction is adjustable.

19. The firearm training system of claim 1 wherein said firearm training system further comprising a sensor unit.

20. The firearm training system of claim 1 wherein said bolt carrier group trigger resetter includes a microcontroller.

* * * * *